US011905766B2

(12) United States Patent
Foulogne et al.

(10) Patent No.: US 11,905,766 B2
(45) Date of Patent: Feb. 20, 2024

(54) THREADED TUBULAR CONNECTION FOR CASING

(71) Applicants: VALLOUREC OIL AND GAS FRANCE, Aulnoye-Aymeries (FR); NIPPON STEEL CORPORATION, Chiyoda-ku (JP)

(72) Inventors: Anthony Foulogne, Boulogne-Billancourt (FR); Pierre Martin, Boulogne-Billancourt (FR)

(73) Assignees: VALLOUREC OIL AND GAS FRANCE, Aulnoye-Aymeries (FR); NIPPON STEEL CORPORATION, Chiyoda-ku (JP)

( * ) Notice: Subject to any disclaimer, the term of this patent is extended or adjusted under 35 U.S.C. 154(b) by 606 days.

(21) Appl. No.: 17/054,705

(22) PCT Filed: May 24, 2019

(86) PCT No.: PCT/EP2019/063434
§ 371 (c)(1),
(2) Date: Nov. 11, 2020

(87) PCT Pub. No.: WO2019/224343
PCT Pub. Date: Nov. 28, 2019

(65) Prior Publication Data

US 2021/0071483 A1 Mar. 11, 2021

(30) Foreign Application Priority Data

May 25, 2018 (EP) ..... 18305641

(51) Int. Cl.
*E21B 17/042* (2006.01)

(52) U.S. Cl.
CPC ..... *E21B 17/0423* (2013.01); *E21B 17/0426* (2013.01)

(58) Field of Classification Search
CPC ..... E21B 17/0423; E21B 17/0426
(Continued)

(56) References Cited

U.S. PATENT DOCUMENTS 6,347,814 B1 2/2002 Cerruti
8,146,960 B2 * 4/2012 Dubedout ..... E21B 43/106 285/334

(Continued)

OTHER PUBLICATIONS

International Search Report dated Jul. 9, 2019 in PCT/EP2019/063434 filed on May 24, 2019.

*Primary Examiner* — Greg Binda
(74) *Attorney, Agent, or Firm* — Oblon, McClelland, Maier & Neustadt, L.L.P.

(57) ABSTRACT

A threaded tubular connection includes a box member having a female external thread, a female internal thread, and a female intermediate sealing surface between the female external thread and the female internal thread, and a pin member having a corresponding male external thread, a male internal thread, and a male intermediate sealing surface, such that male threads interlock by thread engagement with female threads, and intermediate sealing surfaces form an intermediate metal-to-metal seal when the threaded tubular connection is made up. The box member includes a minimal outer diameter at the intermediate metal-to-metal seal location, the minimal outer diameter being smaller than respectively an external and an internal outer diameter respectively being located above the female external thread and the female internal thread.

18 Claims, 3 Drawing Sheets

(58) Field of Classification Search
USPC ..... 285/334
See application file for complete search history.

(56) References Cited

U.S. PATENT DOCUMENTS

| | | | | |
|---|---|---|---|---|
| 8,151,461 | B2 * | 4/2012 | Verger | E21B 17/08 |
| 2006/0162145 | A1 | 7/2006 | Verger et al. | |
| 2012/0325361 | A1 | 12/2012 | Durivault et al. | |
| 2014/0084582 | A1 | 3/2014 | Elder et al. | |
| 2017/0101830 | A1 | 4/2017 | Inose et al. | |

* cited by examiner

THREADED TUBULAR CONNECTION FOR CASING

BACKGROUND

The present invention relates to the field of tubular threaded connections, and joints or assemblies of tubes to be connected by threads.

More particularly, the invention concerns tubes used in industry and, in particular, assemblies or threaded junctions used in string-lines for tubing or for lines of tubular production accessories or for a casing or a liner or a riser for the operation or prospecting or exploitation of oil or gas wells.

The threaded assembly described herein is particularly useful in the assembly of metal tubes used for the casing of oil or gas wells. Casing are needed to maintain borehole stability, prevent contamination of water sands, and control well pressures during drilling, production, and or workover operations.

Those casing tubes are made of steel, according to API standards Specification 5CT for Casing and Tubing. For example, the steel is one of grade L80, P110 or Q125 standards.

Such threaded tubular connections are subjected to a variety of combination of stresses that may vary in intensity or change in direction, such as, for example, axial tension, axial compression, inner pressure bending force, torsional force, etc. . . . . Threaded tubular connections are thus designed to support those stresses, withstand rupture and provide tight sealing.

Numerous types of assemblies are known for petroleum or gas carrying tubes that yield satisfactory results from the viewpoint of mechanical characteristics and tightness, even under tough conditions of use.

A first challenge for casing of oil or gas wells is to install them in the well without damaging their inner and outer surfaces. Casing strings are a succession of pipes, a first serie of casing tubes is of a larger outer diameter than a second serie of casing tubes intended to be jointed to the first serie, but installed deeper in the well. Casing strings are structured such that the diameter progressively reduces as it goes deeper in the well. But transition shall be smooth.

Thus it is needed to insert a new serie of casing having a specific outer diameter into a previously installed serie of casing having a larger diameter and a specific inner diameter. In order to avoid damaging the inner surface of casing already settled in the well, it is required to manage the outer diameter of the new serie of casing. API standard are providing regulation on that topic. Of course, all series of casing shall also comply with efficiency requirement at the location of each connection between two adjacent casing tubes. Connection efficiency or joint efficiency is defined as a ratio of joint tensile strength to pipe body tensile strength, ratio which is evaluated under more severe well conditions, as high external pressure, high internal pressure, high compression or high tension.

Known assemblies comprise tubes equipped with male threads at both ends, assembled by couplings having two corresponding female threads. This type of assembly offers the advantage of rendering the two components of the assembly rigid, due to positive thread interference created between the male and female threads.

However, the outer diameter of these couplings is greater than the outer diameter of the corresponding tubes and, when these assemblies are used with casing tubes, the couplings require that bore holes with increased diameter be drilled to accommodate the outer diameter of the couplings.

In order to overcome this disadvantage, it is common to use assemblies without a coupling or a sleeve, referred to as semi-flush, flush or integral assemblies or junctions or connections. The tubular elements of those integral assemblies each comprise one male threaded end and one female threaded end.

Integral assemblies are generally made on tubes having sized end, respectively an expanded outer diameter at the female threaded end and a swaged outer diameter at the male threaded end, in order to provide a thickness of the connection sufficient enough to ensure mechanical strength of the connection. Expansion and swaging allow to provide higher efficiency to the connection. Both helps minimizing a maximum outer diameter and respectively minimum inner diameter at the location of the connection. Thus the connection allows to maintain a certain level of drift operability, to ease installation in the bore hole without damaging existing casing and to withstand standard for flush or semi-flush integral connection. Flush connection are such that a ratio between outer diameter of the connection over a nominal outer diameter of the tubes is around 1%; whereas ratio for semi-flush are around 2 to 3%.

Reference can be made to document WO-2014/044773 which describes an integral semi-flush threaded tubular connection comprising a first tubular member provided with a tubular male end and a second tubular member provided with a tubular female end. Each of the female and male ends comprises two steps of tapered threads axially and an off-center seal. The aim of this document is to increase the tensile efficiency of the connection, by providing a specific relationship between critical cross-section areas.

However, tolerances in the industry about target nominal diameter dimension, swaging and expansion process, as well as ovality tolerances, are such that it may happen that in some case, due to deflection of the free end (terminal end) of the female end during make-up of the connection, the outer diameter of the female free end may locally create an outer sharp annular edge. The same may occur due to deflection of the free end (terminal end) of the male end during make-up of the connection, the inner diameter of the male free end may locally create an inner sharp annular edge. Thus during installation of a tubing into a casing, or a casing into a casing, friction may occur at between those sharp annular edge and the additional tubing or casing. Friction may create a premature failure of the casing or tubing, even prior production wear. Friction may lead to loose seal efficiency.

There is a need to improve integral threaded tubular connections in order to increase both seal efficiency and tensile efficiency of the connection, while increasing tubing and casing wear robustness.

BRIEF SUMMARY

One aim of the present invention is to overcome these drawbacks.

It is a particular object of the present invention to provide a threaded tubular connection capable of absorbing axial and radial loads as well as supporting radial deformation which may occur under high radial loads, while being compact notably in radial direction.

A threaded tubular connection according to the invention includes a tubular female end extending from a main body of a first tubular member and a tubular male end extending from a main body of a second tubular member. The tubular female end includes a female external thread close from a female free end, a female internal thread closer to the main body of the first tubular member, and a female intermediate sealing surface between the female external thread and the female internal thread. The tubular male end includes a male external thread close to the main body of second tubular member, a male internal thread close to a male free end and a male intermediate sealing surface between the male external thread, and the male internal thread. The male external thread and the male internal thread are configured to respectively interlock by thread engagement with the female external thread and the female internal thread, and male and female sealing surfaces form an intermediate metal-to-metal seal when the threaded tubular connection is made up. The tubular female end includes a minimal outer diameter (JOBmin) at the intermediate metal-to-metal seal location. The minimal outer diameter (JOBmin) is smaller than respectively an external JOBe and an internal JOBi outer diameter. The external outer diameter JOBe is located above at least one thread root of the female external thread and the internal outer diameter JOBi is located above at least one thread root of the female internal thread.

Preferably, at least one of the delta (JOBe-JOBmin) or (JOBi-JOBmin) between the minimal outer diameter JOBmin and respectively the external and the internal outer diameter JOBe; JOBi may be set below a maximum diametrical interference value of the intermediate metal-to-metal seal, for example a ratio between the above delta and the diametrical interference of the intermediate metal-to-metal seal is comprised between 30% and 80%, preferably 40% and 70%.

For example, the minimal outer diameter JOBmin may be constant over a cylindrical surface.

The tubular female end may comprise at least one radiused portion connecting at least one end of a cylindrical surface having the minimal outer diameter JOBmin, for example radiused portions may connect both ends of the cylindrical surface. Radiused portions are concave curved surfaces for example with a radius of curvature of 100 mm or above.

Alternatively or in combination with the above feature, the tubular female end may comprise at least one tapered tronconical portion connecting at least one end of a cylindrical surface having the minimal outer diameter JOBmin, and preferably two tapered tronconical portions for both ends of that cylindrical surface having that minimal outer diameter JOBmin.

The tubular female end may advantageously comprise at least one additional cylindrical portion having a constant diameter equal to either the external JOBe or the internal JOBi outer diameter.

Preferably an outer cylindrical surface having a constant diameter equal to the external outer diameter JOBe is located between the female free end and the location of the tubular female end comprising the minimal outer diameter JOBmin. And preferably, an outer cylindrical surface having a constant diameter equal to the internal outer diameter JOBi is connected to the main body of the first tubular member having a nominal outer diameter with a taper surface forming an expansion angle $\alpha 1$ comprised between 1° and 5°, for example equal to 3°.

A ratio (JOBi/OD) between the internal outer diameter (JOBi) and a nominal outer diameter of the main body of the first tubular member may be comprised between 100.7% and 105%, preferably between 101% and 103%.

After thread engagement of the tubular female end with the tubular male end, at the end of make-up of the threaded tubular connection, an outer diameter at the locations of the intermediate metal-to-metal seal and above at least one of a thread root of the female external thread or a thread root of the female internal thread may remain below a same threshold of 105%, and preferably 104%, and more preferably 102.5% of the nominal outer diameter.

Preferably external and internal outer diameter locations may be equal.

The tubular female end comprises a box critical cross section at a first engaged thread root of the female internal thread such that the box critical cross section may be below the outer cylindrical surface having a constant diameter equal to the internal outer diameter JOBi or below a taper surface forming an expansion angle $\alpha 1$.

The tubular female end may have a female internal sealing surface, and correspondingly the tubular male end may have a male internal sealing surface, wherein the male internal sealing surface is located between the male internal thread and a male free end, such that male and female internal sealing surfaces are forming an internal metal-to-metal seal when the threaded tubular connection is made up.

Advantageously, the tubular female end further may comprise a female shoulder located between the female external thread and the female internal thread, the tubular male end further comprises a male shoulder located between the male external thread and the male internal thread, the male shoulder being configured to abut the female shoulder when the connection is made up.

Preferably, the male free end may remain longitudinally away from an internal shoulder of the tubular female end when the connection is made up. This feature avoid any additional shouldering contact at make up. Alternatively, when more shouldering efficiency is needed, the male free end may abut against an internal shoulder of the tubular female end when the connection is made up.

Preferably the female free end is free of axial abutment contact with the tubular male end. According to the invention, the female free end may slightly be deflected during make up, due to a lack of any axial abutment with the tubular male end during make up. The female free end is longitudinally away from any part of the tubular male end when the connection is made up.

BRIEF DESCRIPTION OF THE DRAWINGS

The present invention and its advantages will be better understood by studying the detailed description of specific embodiments given by way of non-limiting examples and illustrated by the appended drawings on which

DETAILED DESCRIPTION

For clarity reasons, cross sectional view are partial in the sense that they are sectional view along a plane transverse to a longitudinal axis of the tubular member, and only one of the two cross-section of the tubular member is shown.

Figure 2:
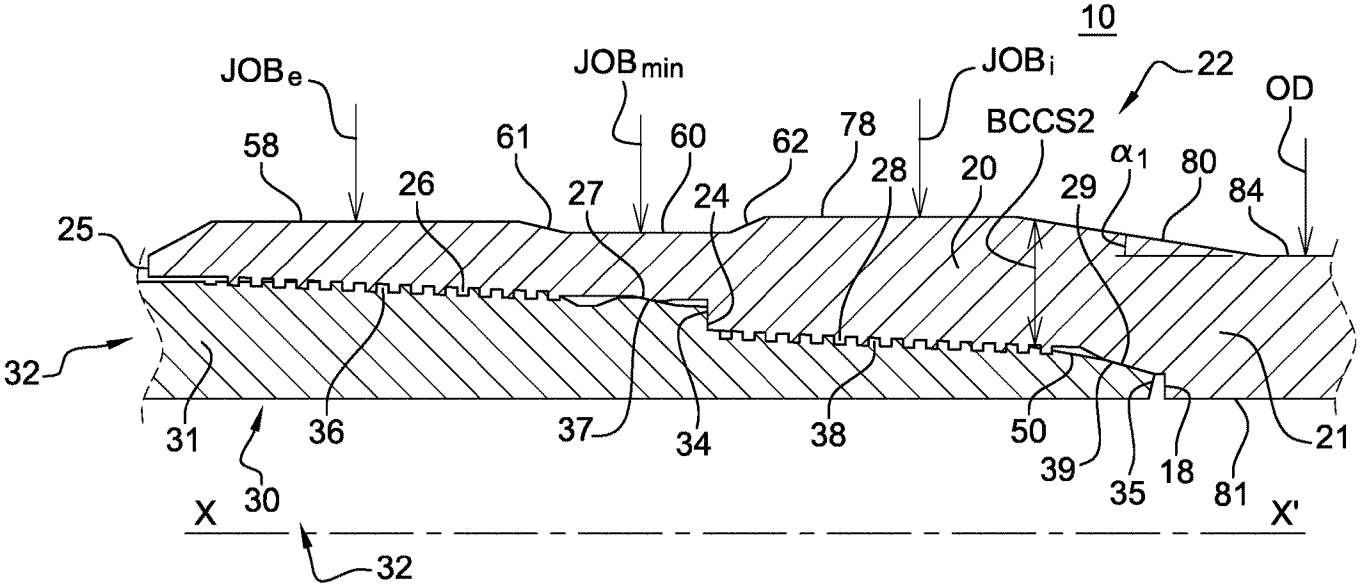
FIG. 2 is a partial cross-sectional view of a threaded connection, in a connected state at the end of a make up step, of the female tubular member of FIG. 1 with a mating male tubular member.

An embodiment of a threaded tubular connection 10 having a longitudinal axis X-X' is illustrated on FIG. 2; said threaded tubular connection 10 comprising a first tubular member 22 and a second tubular member 32.

The first tubular member 22 is provided with a main body 21 referred to as "female main body" and a tubular female end 20 referred to as "box member". The box member 20 extends from the female main body 21. The box member 20 defines a terminal end 25 of said first tubular member 22. The terminal end 25 is a female free end of the box member 20. Female main body 21 presents a nominal outer diameter which is substantially constant over the length of that main body 21 along XX' axis. Preferably an inner diameter ID of that female main body 21 is substantially constant over the length of that main body 21 along XX' axis.

The second tubular member 32 is provided with a main body 31 referred to as "male main body" and a tubular male end 30 referred to as "pin member". The pin member 30 extends from the male main body 31. The pin member 30 defines a terminal end 35 of said second tubular member 32. The terminal end 35 is a male free end of the pin member 30. Male main body 31 presents a nominal outer diameter which is substantially constant over the length of that main body 31 along XX' axis. Preferably an inner diameter of that male main body 31 is substantially constant over the length of that main body 31 along XX' axis.

Main bodies 21 and 31 have same nominal inner diameter ID and nominal outer diameter OD, and thus same pipe width. Preferably, both outer nominal diameter OD and inner nominal diameter ID of main bodies 21 and 31 are substantially constant over the length of those main bodies 21 and 31 along XX' axis.

The threaded tubular connection 10 as illustrated is an integral connection in contrast to assemblies or junctions using a coupling or a sleeve. Preferably the box member extends from main body 21 at one end along the XX' axis, and a pin member identical to the pin member of the second tubular member 32 extends from the main body 21 at an opposite end along that XX' axis. Preferably the pin member extends from main body 31 at one end along the XX' axis, and a box member identical to the box member of the first tubular member 22 extends from the main body 31 at an opposite end along that XX' axis.

An expanded zone of the first tubular member 22 having a greater diameter than nominal outer diameter of main bodies 21 and 31 forms the box member 20. A swaged zone of the second tubular member 32 having a reduced inner diameter compared to a nominal inner diameter of the male main body 31 forms pin member 30.

To manufacture such female end, the first tubular element is first swelled, by using for example cold forming techniques, to expand the outer diameter of the entire box member and to provide a conical tapered outer surface 80 forming an angle $\alpha 1$ comprised between 3° and 4°, for example equal to 3°, with the outer cylindrical surface of the female main body 21.

To manufacture such male end, the second tubular element is first swaged, by using for example cold forming techniques, to reduce the inner diameter of the entire pin member and to provide a conical inner surface 90 forming an angle $\alpha 3$ comprised between 3° and 4°, for example equal to 3°, with the inner cylindrical surface of the male main body 31.

The threaded tubular connection 10 may be a threaded flush or semi-flush integral connection.

Figure 1:
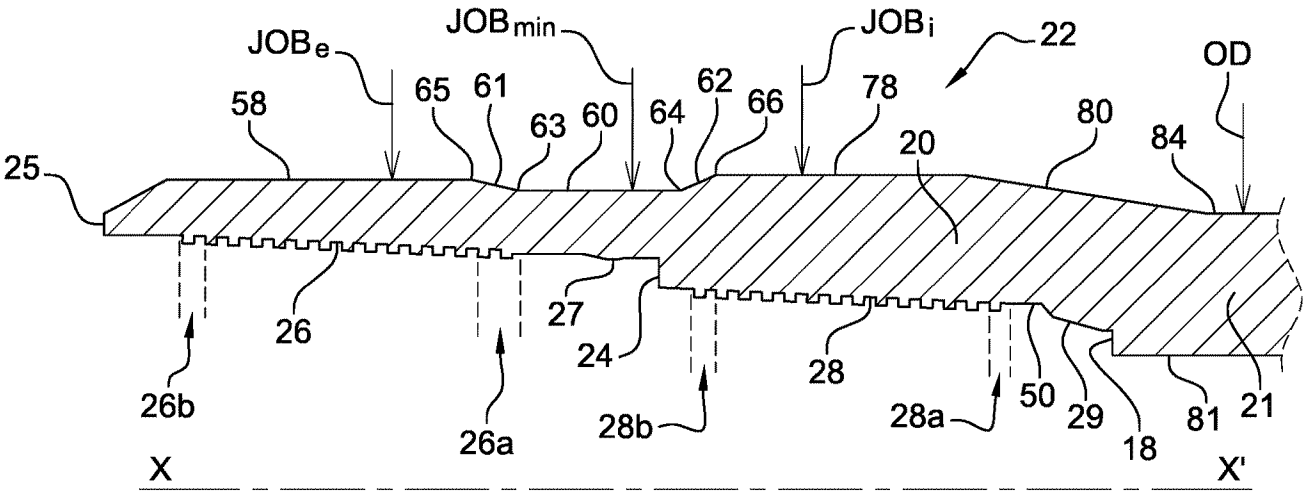
FIG. 1 is a partial cross-sectional view of a female tubular member according to a first embodiment of the invention.

As illustrated in detail on FIG. 1, the free end 25 is preferably an annular surface defined perpendicularly to the XX' axis. The box member 20 comprises on its inner profile a female external thread 26, a female internal thread 28, and a female intermediate sealing surface 27 such that the female external sealing surface 27 is located between the female external thread 26 and the female internal thread 28.

The box member 30 may further comprises successively a female shoulder 24 located between the female external thread 26 and the female internal thread 28. The female shoulder 24 is said intermediate shoulder.

Figure 5:
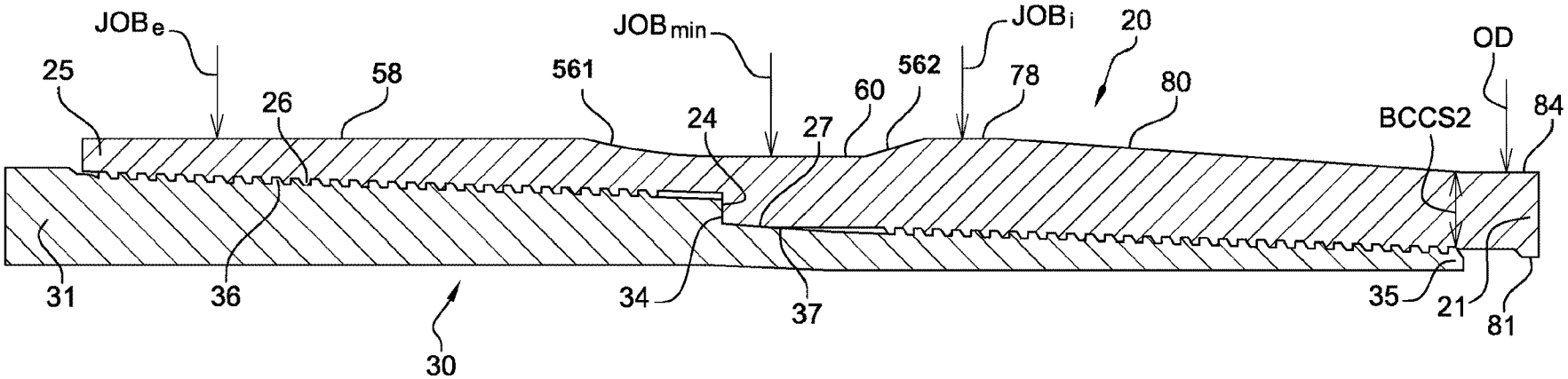
FIG. 5 is another partial cross-sectional view of a threaded connection, in a connected state, along a distinct embodiment of the invention.

According to the embodiments of FIGS. 1, 2 and 5, the female external and internal threads 26 and 28 are radially offset and axially separated by the female shoulder 24. Female shoulder 24 preferably extends as an annular surface perpendicular to the XX' axis. FIG. 5 is distinguishable from the embodiments of FIGS. 1 and 2 in that sense that the intermediate metal-to-metal seal is located between the intermediate shoulder 24 and the female internal thread.

Figure 3:
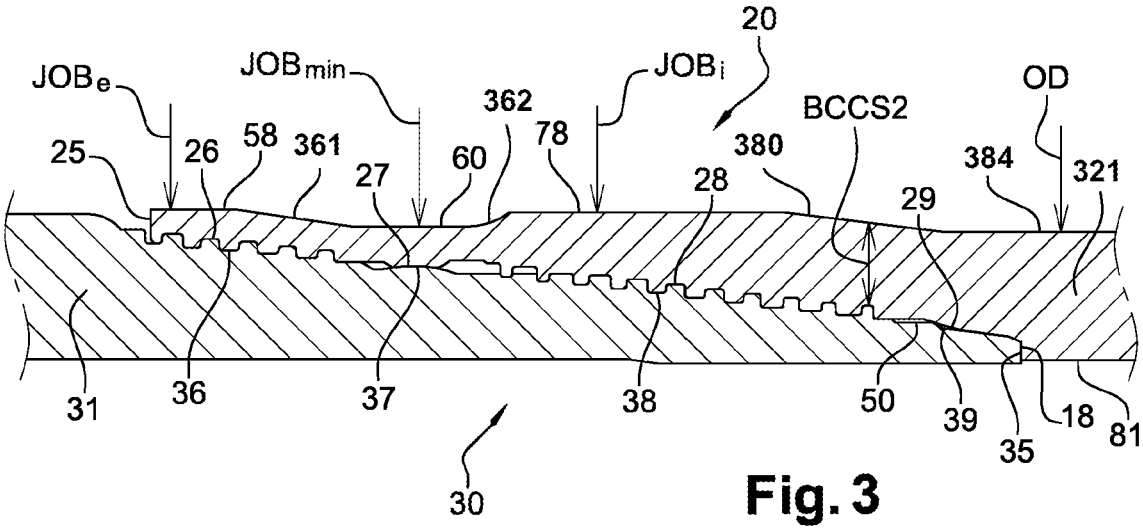
FIG. 3 is a partial cross-sectional view of a threaded connection, in a connected state, along a distinct embodiment of the invention.
Figure 4:
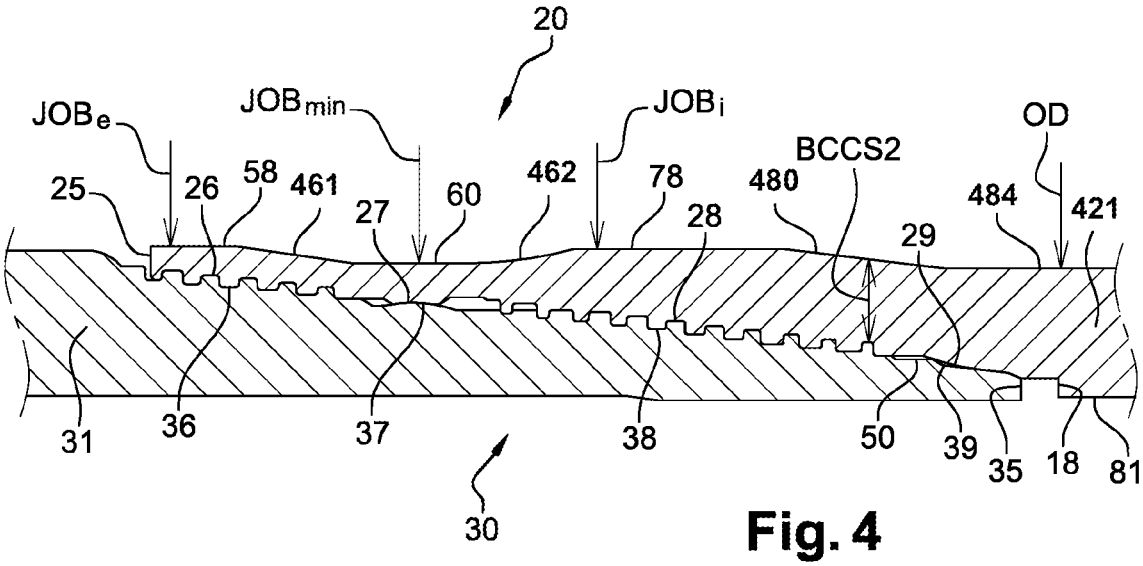
FIG. 4 is another partial cross-sectional view of a threaded connection, in a connected state, along a distinct embodiment of the invention.

According to the embodiments shown on FIGS. 3 and 4, the box member 30 doesn't comprise any intermediate shoulder 24. Thus female external and internal threads 26 and 28 are not radially offset, and are aligned along a same tapered profile.

According to FIGS. 1 to 4, the box member 30 further comprises a female internal sealing surface 29 and an additional shoulder 18, said internal shoulder 18. The female internal sealing surface 29 is located between the female internal thread 28 and the internal shoulder 18. The internal shoulder 18 is connected to an inner junction surface 81 defined between the internal shoulder 18 and the female main body 21.

The inner profile of the box member 20 is machined on the inner surface after having been expanded.

The female external and internal threads 26 and 28 are provided on tapered surface, for example with a taper value between 1/18 and 1/8. More particularly, a taper angle between a tapering axis of the female threads and the longitudinal axis XX' of the connection is at approximately 10°, such that the inner diameter of the box member 20 decreases towards the female main body 21.

The female external and internal threads 26 and 28 may have the following features:

a same pitch, same loading flanks angle with a negative angle value, same trapezoidal shape teeth profile, same longitudinal length.

The female external and internal threads 26 and 28 are configured to interlock by thread engagement with respectively the male external and internal threads 36 and 38, such that they are respectively tapered along a same taper angle. The male external and internal threads 36 and 38 have the same pitch, same as those of the female external and internal threads 26 and 28 respectively.

The thread form will not be described in detail. Each tooth of the threads may conventionally include a stabbing flank, a loading flank, a crest surface and a root surface. The teeth of both threaded sections may be inclined so that the stabbing flanks have a negative angle and the stabbing flanks have a positive angle, or the stabbing flanks have a positive angle and the stabbing flanks have a negative angle. Alternatively, the teeth of both threaded sections may be trapezoidal teeth.

According to the embodiments of the invention represented on FIGS. 1, 2 and 5, the threads according to the invention present loading flanks and stabbing flanks with the exact same pitch and lead.

According to the embodiments of the invention represented on FIGS. 3 and 4, threads of both threaded sections are wedge. Wedge threads are characterized by threads, regardless of a particular thread form, that increase in width as they become farther from the free end.

Preferably the threads according to the invention present a diametrical interference.

The female external and internal threads 26 and 28 are configured to interlock by thread engagement with corresponding features of the pin member 30. By interlock by thread engagement it is encompassed that at least 2, and preferably at least 3 turns of a female thread is meshed within a spiralled groove defined between corresponding 2 to 3 turns of the male thread. When seen according to a longitudinal cross section, along XX' axis, each teeth of a male thread is located in between two adjacent teeth of the female thread, this being observable for at least 3 turns of a thread. At the end of make-up, threads are meshed.

Thus, as illustrated in detail on FIG. 2, the pin member 30 comprises successively as from the male free end 35 on its external profile: a male inner sealing surface 39, the male internal thread 38, a male intermediate shoulder 34, a male intermediate sealing surface 37, and a male external thread 36 and a junction surface 91 to the male main body 31. The outer profile of the pin member 30 is machined on the outer surface after having been swaged.

According to the embodiments of the invention represented on FIGS. 1, 2 and 5, the male external and internal threads 36 and 38 are radially offset and axially separated by the male shoulder 34. Male shoulder 34 preferably extends as an annular surface perpendicular to the XX' axis.

According to a first embodiment of the invention, each of the female external and internal threads 26 and 28 comprises a run-in portion 26*a* and respectively 28*a* on the side of the female free end 25 and a run-out portion 26*b* and respectively 28*b* on the opposite side. Run-in thread and run-out thread are imperfect thread in the sense that they do not have the full height that is observed for the thread portion in between respective run-in and run-out portions.

Each of the male external and internal threads 36 and 38 comprises a run-in portion 36*a* and respectively 38*a* on the side of the male free end 35 and a run-out portion 36*b* and respectively 38*b* on the opposite side. Each run-in portion 26*a* and respectively 28*a* on the box member 20 engages a run-out portion 36*b* and respectively 38*b* on the pin member 30, and each run-in portion 36*a* and respectively 38*a* on the pin member 30 engages a run-out portion 26*b* and respectively 28*b* on the box member 20.

FIGS. 1, 2 and 5, female and male thread comprises those run-in and run-out section. According to an alternative not shown, the connection may comprise only full height thread.

In a made up state of the connection 10, a first engaged thread root of the female thread is the first tread root location, when considering successive thread root starting from the run-in portion 26*a* or 28*a* of the female external and respectively internal thread, where a corresponding thread of the male thread 36 or 38 is engaged. An engaged thread means that at least a portion of the loading flank of the female thread is contacting the corresponding loading flank of the male thread in the made up state. When considering successive thread root starting from run-in portions 26*a* and respectively 28*a*, first location of a female thread's loading flank to contact is adjacent to the first engaged thread root of the female external thread and respectively of the female internal thread.

In a made up state of the connection 10, a first engaged thread root of the male thread is the first tread root location, when considering successive thread root starting from the run-in portion 36*a* or 38*a* of the male external and respectively internal thread, where a corresponding thread of the female thread 26 or 28 is engaged. An engaged thread means that at least a portion of the loading flank of the male thread is contacting the corresponding loading flank of the female thread in the made up state. When considering successive thread root starting from run-in portions 36*a* and respectively 38*a*, first location of a male thread's loading flank to contact is adjacent to the first engaged thread root of the male external thread and respectively of the male internal thread.

At the end of make-up of a connection according to the embodiments of the invention represented on FIGS. 1, 2 and 5, intermediate shoulders 24 and 34 abuts each other, and threads are interlocked by thread engagement.

At the end of make-up of a connection according to an embodiment of the invention according to FIG. 3, the female internal shoulder 18 abuts with a corresponding pin free end 35, and female thread cooperate with corresponding male thread such that at least one of the stabbing flanks and the loading flanks are abutting each other.

At the end of make-up of a connection according to an embodiment of the invention according to FIG. 4, where internal shoulder 18 is not abutting any pin free end 35, female thread cooperate with corresponding male thread such that both stabbing flanks and loading flanks are abutting each other.

According to the invention, the first engaged thread root of the female external thread is within the run-in portion 26*a*, and the first engaged thread root of the female internal thread is within the run-in portion 28*a*. Respectively, the first engaged thread root of the male external thread is within the run-in portion 36*a*, and the first engaged thread root of the male internal thread is within the run-in portion 38*a*.

BCCS2 is a section defined transversely to the XX' axis across the box member at the first engaged thread root of the female internal thread. According to FIGS. 1 to 5, BCCS2 falls within the run in portion 28*a*. BCCS2 is closer from the female internal sealing surface 29 than the female shoulder 24. A box critical cross section is a cross-sectional area of the box member 20 which undergoes the maximum tension transferred across all threads and defines efficiency of the connection.

As illustrated, the female intermediate sealing surface 27 is conical, and the male intermediate sealing surface 37 is also conical. The taper of the conical surfaces 27 and 37 may be equal, for example of ½. Female and male intermediate sealing surface 27 and 37 create a metal-to-metal seal in a made up position of the connection 10.

The female internal sealing surface 29 is a convexly bulged surface for example a torical surface defined by a torus radius between 10 and 100 mm, for example equal to 60 mm; and the male internal sealing surface 39 is conical. Female and male internal sealing surface 29 and 39 create a metal-to-metal seal in a made up position of the connection 10. Alternatively, external and internal metal-to-metal seal can be both of the cone-to-cone type with a substantially same taper. Alternatively, female and male intermediate sealing surface 27 and 37 may define a tore-to-cone metal-to-metal seal.

In order to achieve a metal-to-meal seal, a diametrical interference is needed between female and male sealing surface. Diametrical interference value is the maximum difference between an outer diameter of the male sealing surface minus an inner diameter of the female sealing surface, diameters being considered at a same location along the XX' axis when the connection is made up, but diameter are those prior make-up. Diametrical interference is defined prior make up, based on FEA analysis and predictable final position of respectively the pin member into the box member at the end of make up.

For example, diametrical interference of the intermediate metal-to-metal seal is comprised between 0.2 mm and 1.2 mm; preferably between 0.4 mm and 0.8 mm. For example, diametrical interference of the internal metal-to-metal seal is comprised between 0.3 mm and 1.7 mm; preferably between 0.7 mm and 1.5 mm. For example diametrical interference of the intermediate metal-to-metal seal is set below the diametrical interference of the internal metal-to-metal seal.

Deflection of the box free end 25 outside of the connection due to the intermediate metal-to-metal seal and deflection of the pin free end 35 inside the connection due to the internal metal-to-metal seal are limited by the specific features of the invention.

In the description, unless otherwise specified, all outer diameter and inner diameter dimension are considered prior make up, as they stand after machining. According to manufacturing tolerances, all dimensions are specified with tolerances of +/−0.2 mm compared to a target value.

Advantageously, the box member 20 outer surface is partially machined. Above the female intermediate sealing surface 27, the box member is machined in order to provide locally a cylindrical surface 60 with a minimal outer diameter JOBmin. Cylindrical surface 60 is cylindrical within tolerances of machining of metal parts.

Machined cylindrical surface 60 extends on both sides of the female intermediate sealing surface 27. According to preferred embodiments of the invention, the machined cylindrical surface 60 is not extending above any of the female external or internal threads 26 and respectively 28. For example, where the run-in portion 26*a* of the female external threads 26 starts, the machined cylindrical portion 60 ends, and when the run-out portion 28*b* of the female internal threads 28 starts, the machined cylindrical portion 60 ends.

Thus the machined cylindrical portion 60 extends on the whole longitudinal length along the X-X' axis between the female external thread 26 and the internal threads 28. The second cylindrical surface 60 has a length along the XX' axis comprised between 10 mm and 100 mm.

Machined cylindrical surface 60 has adjacent radiused or tronconical portions 61 and respectively 62, on both side, in order to join an external cylindrical portion 58 and an internal cylindrical portion 78. External cylindrical portion 58 and internal cylindrical portion 78 each respectively present a constant diameter equal to an external outer diameter JOBe and respectively an internal outer diameter JOBi. Tronconical portions 61 and respectively 62 may be tapered with a taper angle comprised between 3° and 45°, preferably between 5° and 15°. The external cylindrical portion 58 and the internal cylindrical portion 78 have a length along the XX' axis of at least 25 mm.

For example, adjacent portions 61 and 62 of the machined cylindrical portion 60 extend respectively above at least the run-in portion 26*a* of the female external threads 26, and respectively above the run-out portion 28*b* of the female internal threads 28. Adjacent portions 61 and 62 may also extend above full height thread of the respective female external and internal thread 26 and 28.

According to the invention, the external outer diameter JOBe and respectively the internal outer diameter JOBi are defined at location above at least one thread root of the female external thread 26 and respectively the female internal thread 28. Preferably, external cylindrical portion 58 and internal cylindrical portion 78 extend respectively above the full height thread of the respective female external and internal thread 26 and 28.

According to the invention, both external outer diameter JOBe and respectively internal outer diameter JOBi are strictly superior to the minimum outer diameter JOBmin. Preferably, external outer diameter JOBe and internal outer diameter JOBi are equal.

Adjacent portions 61 and 62 are connecting the machined cylindrical surface 60 having the minimal outer diameter JOBmin by concave toric surfaces respectively 63 and 64. Respectively the adjacent portions 61 and 62 are connecting the external cylindrical portion 58 and the internal cylindrical portion 78 by convex toric surfaces respectively 65 and 66.

On FIGS. 1 and 2, the female member comprises tapered tronconical portions 61 and 62. For example, both tapered tronconical portions 61 and 62 are presenting a same taper angle value.

As an alternative of FIGS. 1 and 2, instead of tapered tronconical portions 61 and 62, adjacent portions 61 and 62 may be concave radiused portions curved with a radius of curvature larger than the radius of curvature of the concave toric surfaces respectively 63 and 64. For example, concave radiused portions 61 and 62 may present a same radius of curvature equal to 100 mm or above.

FIGS. 3 to 5 are representing distinct embodiments according to the invention wherein the adjacent portions 361 and 362 in FIGS. 3, 461 and 462 in FIG. 4, and 561 and 562 in FIG. 5 are concave radiused portions curved such that respective adjacent portions 361 and 362 in FIGS. 3, 461 and 462 in FIG. 4, and 561 and 562 in FIG. 5 are presenting radius of curvature of distinct value. FIG. 3, for example, shows a radius of curvature of adjacent portion 361 which is located between the external cylindrical portion 58 and the machined cylindrical surface 60 is greater than a radius of curvature of adjacent portion 362 which is located between the machined cylindrical surface 60 and the internal cylindrical portion 78.

The internal cylindrical portion 78 connects the conical tapered outer surface 80 forming the angle $\alpha 1$.

FIGS. 1 to 4, the conical tapered outer surface 80, 380, 480 expands above a groove 50 located between the female internal thread 28 and the female internal sealing surface 29. FIGS. 1 and 2, the conical tapered outer surface 80 further expands over the female internal sealing surface 29, whereas FIGS. 3 and 4, the conical tapered outer surface 380, 480 connects with an outer female surface 384, 484 of the main body 321, 421 such that the outer female surface 384, 484 is cylindrical and located above the female internal sealing surface 29.

All further ratios or deltas identified below are based on target value of each outer diameter dimension without considering tolerances.

For example, delta (JOBe-JOBmin) or (JOBi-JOBmin) between the minimal outer diameter (JOBmin) and respectively the external and the internal outer diameter (JOBe; JOBi) is below a maximum diametrical interference value of the intermediate metal-to-metal seal, for example a ratio between the above delta and the diametrical interference is comprised between 30% and 80%, preferably 40% and 70%.

For example, the ratio (JOBmin/OD) between the minimum outer diameter JOB and the nominal outer diameter OD is comprised between 100.1% and 104%, preferably between 100.8% and 103%.

the ratio JOBi/OD between the internal outer diameter JOBi and a nominal outer diameter of the main body of the first tubular member is comprised between 100.7% and 105%, preferably between 101% and 103%.

the ratio JOBe/OD between the external outer diameter JOBe and a nominal outer diameter of the main body of the first tubular member is comprised between 100.7% and 105%, preferably between 101% and 103%.

the ratio JOBi/JOBmin between the internal outer diameter JOBi and the minimum outer diameter JOBmin is comprised between 100.01% and 104%, preferably between 100.05% and 101%.

the ratio JOBe/JOBmin between the external outer diameter JOBe and the minimum outer diameter JOBmin is comprised between 100.01% and 104%, preferably between 100.05% and 101%.

For all embodiments of the invention, at the end of make up, outer diameter dimensions are modified all along the box member 20 due to either and/or both thread interference and metal-to-metal seal interference. FIGS. 2 to 5 represent threaded connection at the end of make-up, but in order to allow better description of these embodiments, locations of JOBe, JOBi and JOBmin are identified on those figures, but only point out respective former locations of those specific dimensions, as machined and prior make up.

At the end of make up, for example the machined cylindrical surface 60 may not be cylindrical anymore, and the same for all outer surfaces. But thanks to the invention, after make up, at all location of the box member 20 the outer diameter of the connection 10 remains below a threshold of 105%, and preferably 103%, and more preferably 101% of the nominal outer diameter of the female main body 21.

Thanks to the specific feature of having cylindrical outer surfaces 58, 60 and 78, there is no direct radial contact with box nose and casing already in place during installation. Indeed, the thickness of the box member 20 at the second critical cross section BCCS2 allows to the box member to have a better casing wear robustness, while allowing the connection to have a good efficiency.

Thanks to the additional thickness at box critical cross sections, the connection have a better casing wear robustness, while having a better efficiency and good performance when the connection is subjected to axial tension.

The service life of the connection is also improved since the free end of the box member is not in direct radial contact.

The invention claimed is:

1. A threaded tubular connection, comprising:

a tubular female end extending from a main body of a first tubular member, the tubular female end comprising a female external thread close from a female free end, a female internal thread closer to the main body of the first tubular member, and a female intermediate sealing surface between the female external thread and the female internal thread; and a tubular male end extending from a main body of a second tubular member, the tubular male end comprising a male external thread close to the main body of second tubular member, a male internal thread close to a male free end and a male intermediate sealing surface between the male external thread and the male internal thread, wherein the male external thread and the male internal thread are configured to respectively interlock by thread engagement with the female external thread and the female internal thread, and male and female sealing surfaces form an intermediate metal-to-metal seal when the threaded tubular connection is made up, wherein the tubular female end comprises a minimal outer diameter at the intermediate metal-to-metal seal location, the minimal outer diameter being smaller than respectively an external and an internal outer diameter, the external outer diameter being located above at least one thread root of the female external thread, the internal outer diameter being located above at least one thread root of the female internal thread, wherein the threaded tubular connection includes a longitudinal axis wherein the minimal outer diameter is constant over a cylindrical surface, the cylindrical surface extending from a first position on the longitudinal axis where the female external thread ends to a second position on the longitudinal axis where the female internal thread begins.

2. The threaded tubular connection according to claim 1, wherein at least one of the delta between the minimal outer diameter and respectively the external and the internal outer diameter is below a maximum diametrical interference value of the intermediate metal-to-metal seal.

3. The threaded tubular connection according to claim 2, wherein a ratio between the delta and the diametrical interference is between 30% and 80%.

4. The threaded tubular connection according to claim 1, wherein the minimal outer diameter is constant over a cylindrical surface.

5. The threaded tubular connection according to claim 1, wherein the tubular female end comprises a radiused portion connecting at least one end of a cylindrical surface having the minimal outer diameter.

6. The threaded tubular connection according to claim 5, wherein the radiused portions connect both ends of the cylindrical surface and are concave curved surface along a radius of curvature of 100 mm or above.

7. The threaded tubular connection according claim 5, wherein the tubular female end comprises a tapered tronconical portion connecting at least one end of the cylindrical surface having the minimal outer diameter.

8. The threaded tubular connection according to claim 1, wherein the tubular female end comprises at least one additional cylindrical portion having a constant diameter equal to external or internal outer diameter.

9. The threaded tubular connection according to claim 8, wherein the at least one additional cylindrical portion includes an outer cylindrical surface having a constant diameter equal to the external outer diameter is located between the female free end and the location of the tubular female end comprising the minimal outer diameter.

10. The threaded tubular connection according to claim 8, wherein at least one additional cylindrical portion includes an outer cylindrical surface having a constant diameter equal to the internal outer diameter is connected to a cylindrical outer female surface of the main body of the first tubular member having a nominal outer diameter by a taper surface forming an expansion angle between 1° and 5°.

11. The threaded tubular connection according to claim 10, wherein the tubular female end comprises a box critical cross section at a first engaged thread root of the female internal thread such that the box critical cross section is below the taper surface forming the expansion angle.

12. The threaded tubular connection according to claim 1, wherein the ratio between the internal outer diameter and a nominal outer diameter of the main body of the first tubular member is between 100.7% and 105%.

13. The threaded tubular connection according to claim 1, wherein after thread engagement of the tubular female end with the tubular male end, at the end of make-up of the threaded tubular connection, an outer diameter at the locations of the intermediate metal-to-metal seal, and above at least one of a thread root of the female external thread or a thread root of the female internal thread are below a same threshold of 105% of the nominal outer diameter.

14. The threaded tubular connection according to claim 1, wherein the external and internal outer diameters are equal.

15. The threaded tubular connection according to claim 1, wherein the tubular female end has a female internal sealing surface, the tubular male end has a male internal sealing surface, wherein the male internal sealing surface is located between the male internal thread and a male free end, such that male and female internal sealing surfaces form an internal metal-to-metal seal when the threaded tubular connection is made up.

16. The threaded tubular connection according to claim 1, wherein the male free end is longitudinally away from an internal shoulder of the tubular female end when the connection is made up.

17. The threaded tubular connection according to claim 1, wherein the male free end abuts against an internal shoulder of the tubular female end when the connection is made up.

18. The threaded tubular connection according to claim 1, wherein the tubular female end further comprises a female shoulder located between the female external thread and the female internal thread, the tubular male end further comprises a male shoulder located between the male external thread and the male internal thread, the male shoulder being configured to abut the female shoulder when the connection is made up.

* * * * *